US009949526B2

(12) United States Patent
Spriggs

(10) Patent No.: US 9,949,526 B2
(45) Date of Patent: Apr. 24, 2018

(54) FO-FA-TU

(71) Applicant: Delbert Roy Spriggs, Edmond, OK (US)

(72) Inventor: Delbert Roy Spriggs, Edmond, OK (US)

(73) Assignee: DELSERVICES GROUP, INC., Oklahoma City, OK (US)

( * ) Notice: Subject to any disclaimer, the term of this patent is extended or adjusted under 35 U.S.C. 154(b) by 64 days.

(21) Appl. No.: 14/166,568

(22) Filed: Jan. 28, 2014

(65) Prior Publication Data

US 2015/0208764 A1 Jul. 30, 2015

(51) Int. Cl.

| | |
|---|---|
| ***B65D 85/00*** | (2006.01) |
| ***A43B 3/00*** | (2006.01) |
| ***A43B 1/00*** | (2006.01) |

(52) U.S. Cl.

CPC ..... *A43B 3/0094* (2013.01); *A43B 1/0027* (2013.01)

(58) Field of Classification Search

CPC ..... B65D 2203/00; A43B 3/24; A43B 3/0094; A43B 1/0027

USPC ..... 206/459.5, 281, 292, 297, 299; 36/100, 36/101

See application file for complete search history.

(56) References Cited

U.S. PATENT DOCUMENTS

| | | | | | |
|---|---|---|---|---|---|
| 2,887,792 | A * | 5/1959 | Staff | A43B 1/0072 | 36/1 |
| 6,109,514 | A * | 8/2000 | Otis | B65D 5/4225 | 206/459.5 |
| 6,213,298 | B1 * | 4/2001 | Nguyen | B65D 5/422 | 206/459.1 |
| 6,595,355 | B1 * | 7/2003 | Hooper | A47G 25/005 | 206/292 |
| 7,906,199 | B2 * | 3/2011 | Rearick | A43B 1/0027 | 36/98 |
| 2002/0020082 | A1 * | 2/2002 | James | A43B 3/0078 | 36/112 |
| 2006/0000737 | A1 * | 1/2006 | Vogel | A47F 3/142 | 206/459.5 |
| 2009/0038181 | A1 * | 2/2009 | Loughnane | A43B 3/24 | 36/94 |
| 2009/0100714 | A1 * | 4/2009 | Coger | A43B 1/0081 | 36/100 |
| 2010/0314268 | A1 * | 12/2010 | Goodman | B65D 5/0015 | 206/281 |
| 2013/0031801 | A1 * | 2/2013 | Hatfield | A43B 3/24 | 36/83 |

* cited by examiner

*Primary Examiner* — Jacob K Ackun
*Assistant Examiner* — Jenine Pagan
(74) *Attorney, Agent, or Firm* — Hall Estill Attorneys at Law

(57) ABSTRACT

An apparatus and associated method contemplating an indicia marked on a package to identify a particular construction of color-mismatched footwear contained in the package. The indicia includes a brand identifying the footwear as being color-mismatched, a style identifying a characteristic construction of the footwear, and a generation level identifying an arrangement of the colors for the color-mismatched footwear.

9 Claims, 11 Drawing Sheets

FO-FA-TU

FIELD

The present embodiments relate generally, without limitation, to devices and associated methods for merchandising footwear.

SUMMARY

Some embodiments of the present invention contemplate an indicia marked on a package to identify a particular construction of color-mismatched footwear contained in the package. The indicia includes a brand identifying the footwear as being color-mismatched, a style identifying a characteristic construction of the footwear, and a generation level identifying an arrangement of the colors for the color-mismatched footwear.

Some embodiments of the present invention contemplate a method including steps of: obtaining a pair of color-mismatched footwear; identifying the pair of color-mismatched footwear with a brand indicia that characterizes the footwear as being color-mismatched; identifying the pair of color-mismatched footwear with a style indicia that characterizes a particular construction of the color-mismatched footwear; and identifying the pair of color-mismatched footwear with a generation level indicia that characterizes the arrangement of colors in the color-mismatched footwear.

DETAILED DESCRIPTION OF ILLUSTRATIVE EMBODIMENTS

Generally, embodiments of the present invention contemplate an apparatus and associated methodology for merchandising footwear. Generally, a pair of shoes is marketed and sold as a subset of a larger group of shoes. As described below, at the lowest level of this marketing technology, the present embodiments generally contemplate packaging, for sale, a pair of shoes that are mismatched in color. That is, the shoes are constructed of parts that are of different colors, and the mismatch involves the same part of each shoe in the pair being a different color. For example, the toe cap of one shoe in the pair is one color and the toe cap of the other shoe in the pair is a different color. The particulars of the mismatch are identifiable to the consumer by marketing indicia (or nomenclature) associated with the pair of shoes, in accordance with the embodiments of this invention. Generally, the construction of a pair of mismatched shoes can be designated by a style nomenclature. The style is generally the name consumers will associate with a particular shoe construction, regardless of color. That is, preferably any given style of shoe will be marketed in multiple color combinations. For purposes of this illustrative description, the style nomenclature is referred to as "Flash."

Figure 1:
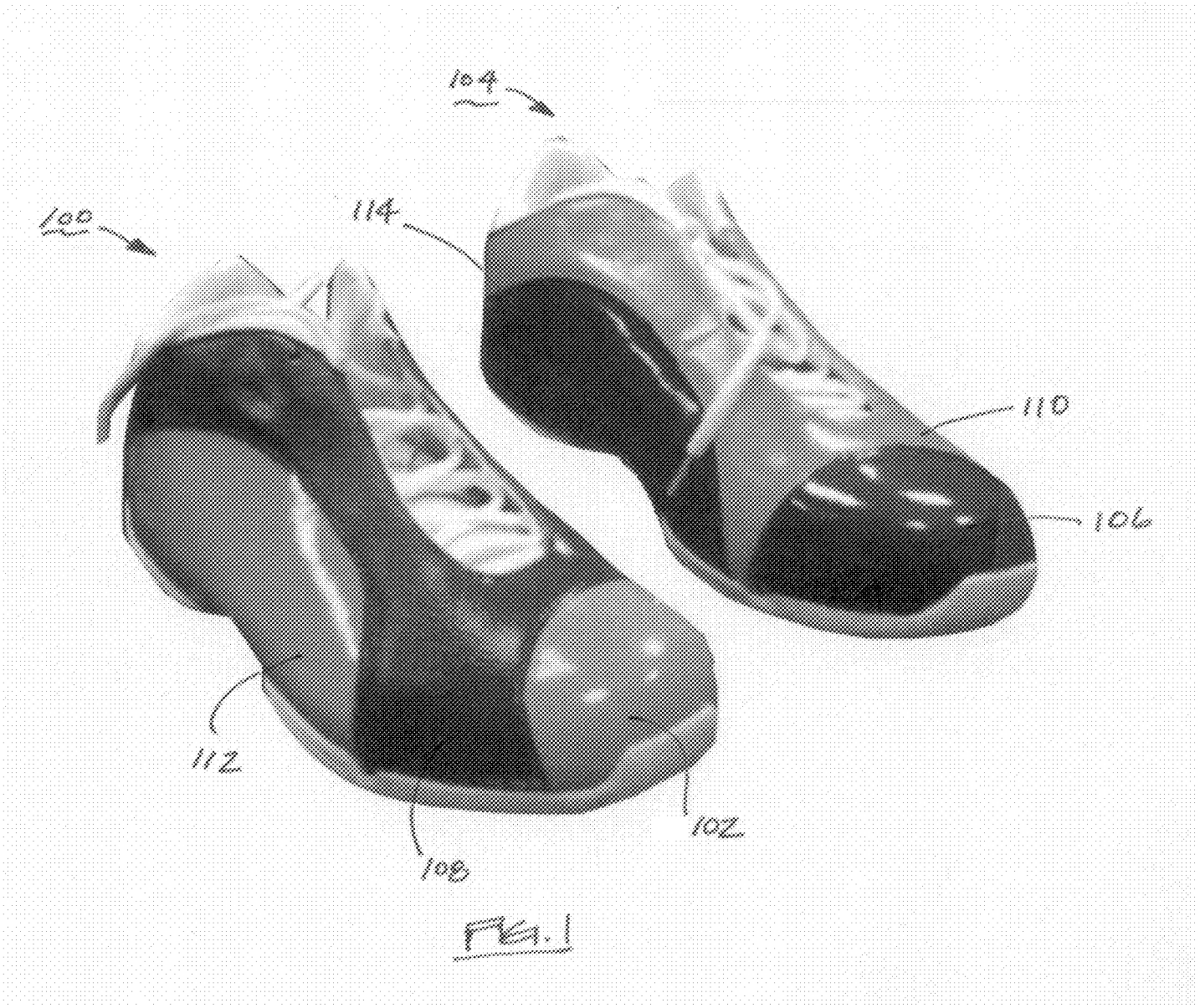
FIG. 1 is a right side isometric depiction of a pair of illustrative first generation (gen) color-mismatched shoes that are marketed as a subset of a larger group of shoes in accordance with illustrative embodiments of the present invention.

FIG. 1 is an isometric depiction of a pair of mismatched shoes constructed in accordance with illustrative embodiments of the present invention. The style nomenclature "Flash" in these illustrative embodiments identifies the general construction of the shoes in terms of the shapes of its various components. For example, the characteristic shape and size of the toe cap, the upper, and the sidewall identifies this style to the consumer as being "Flash" style shoes.

Figure 2:
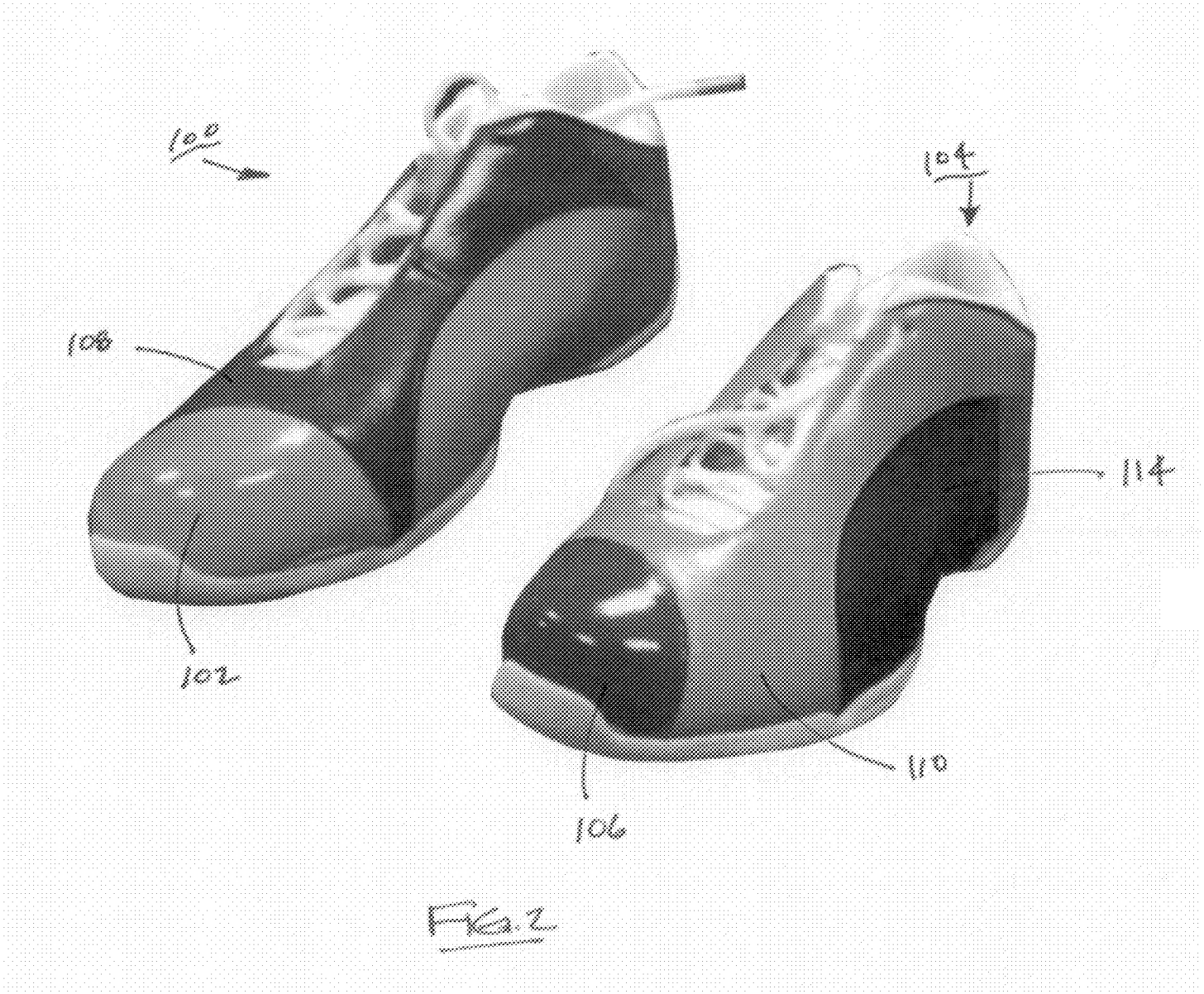
FIG. 2 is a left side isometric depiction of the first gen shoes in FIG. 1.
Figure 3:
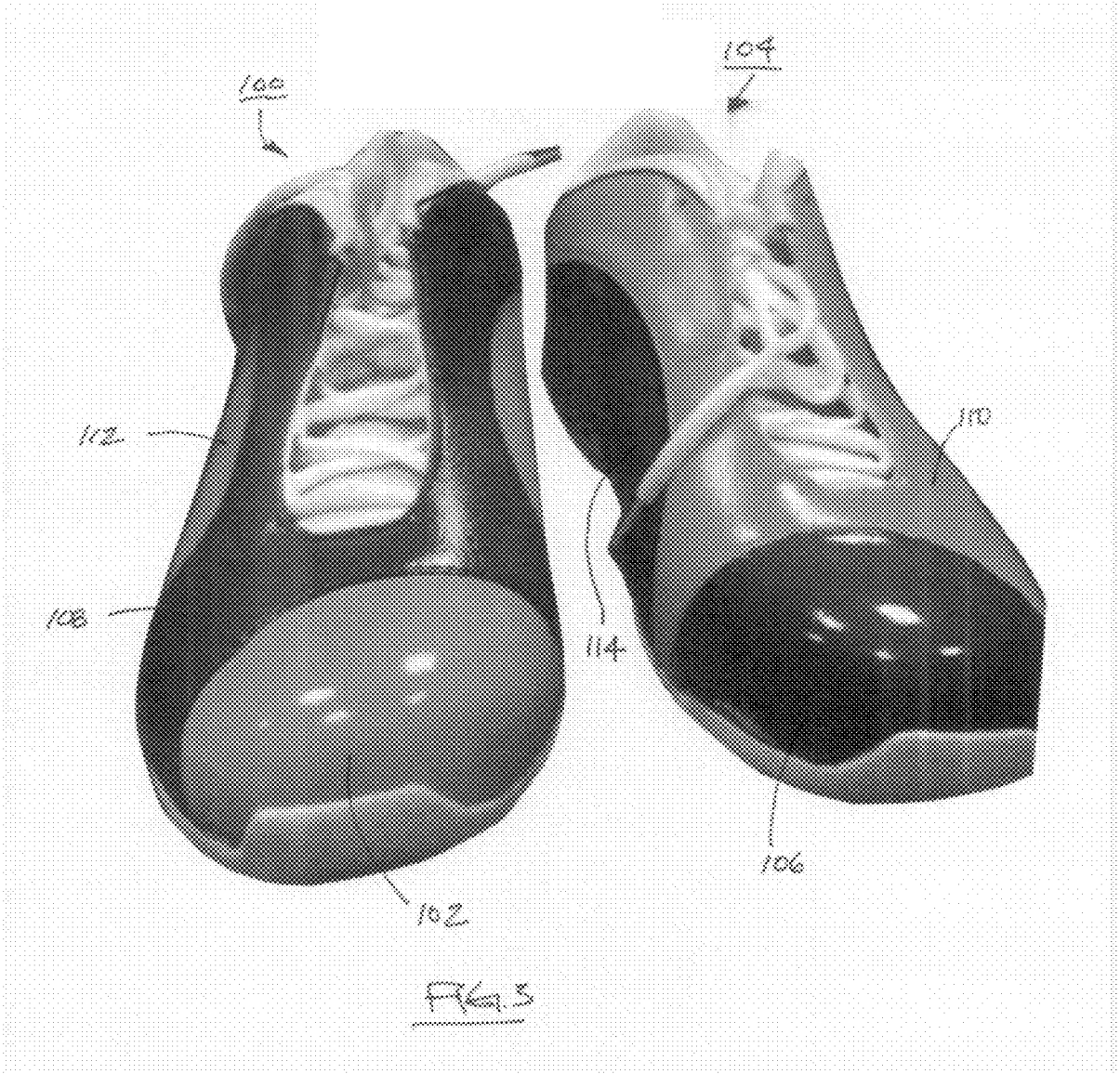
FIG. 3 is a frontal isometric depiction of the first gen shoes in FIG. 1.

The right shoe 100 (nearest in FIG. 1) has a lighter-colored (such as orange) toe cap 102 whereas the left shoe 104 (farthest in FIG. 1) has a darker-colored (such as blue) toe cap 106. Similarly, the right shoe 100 has a darker-colored upper 108 whereas the left shoe 104 has a lighter-colored upper 110. Similarly, the right shoe 100 has a lighter-colored sidewall 112 whereas the right shoe 104 has a darker-colored sidewall 114. Generally, the mismatch pattern can be continued to other parts of the shoe construction as well, such as the laces and the tongue and the like, the parts being constructed of opposite colors in the respective shoes 100, 104. FIGS. 2 and 3 depict other isometric depictions of the shoes 100, 104 in FIG. 1.

Figure 4:
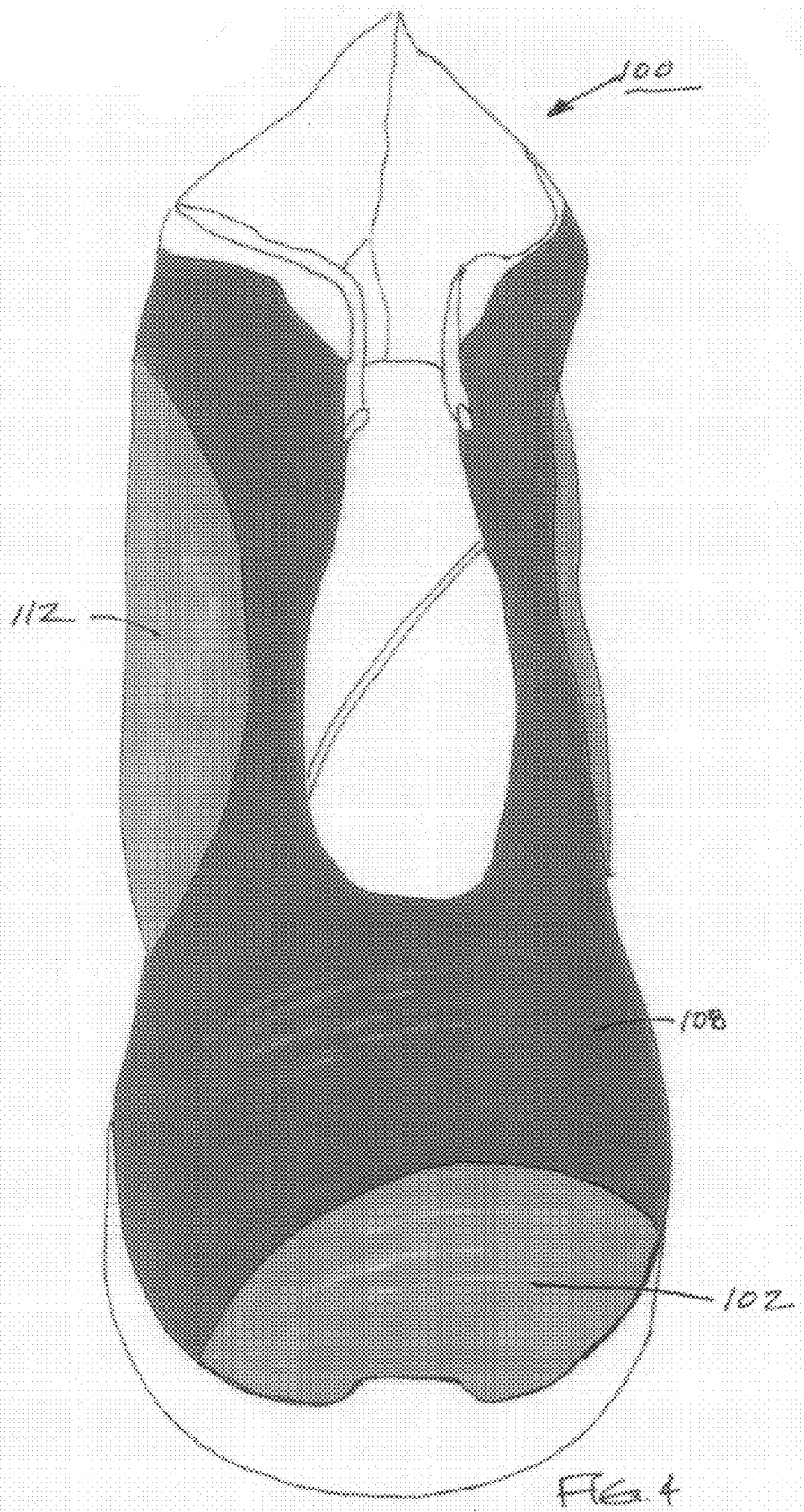
FIG. 4 is an isometric depiction of the right first gen shoe in FIG. 1.
Figure 5:
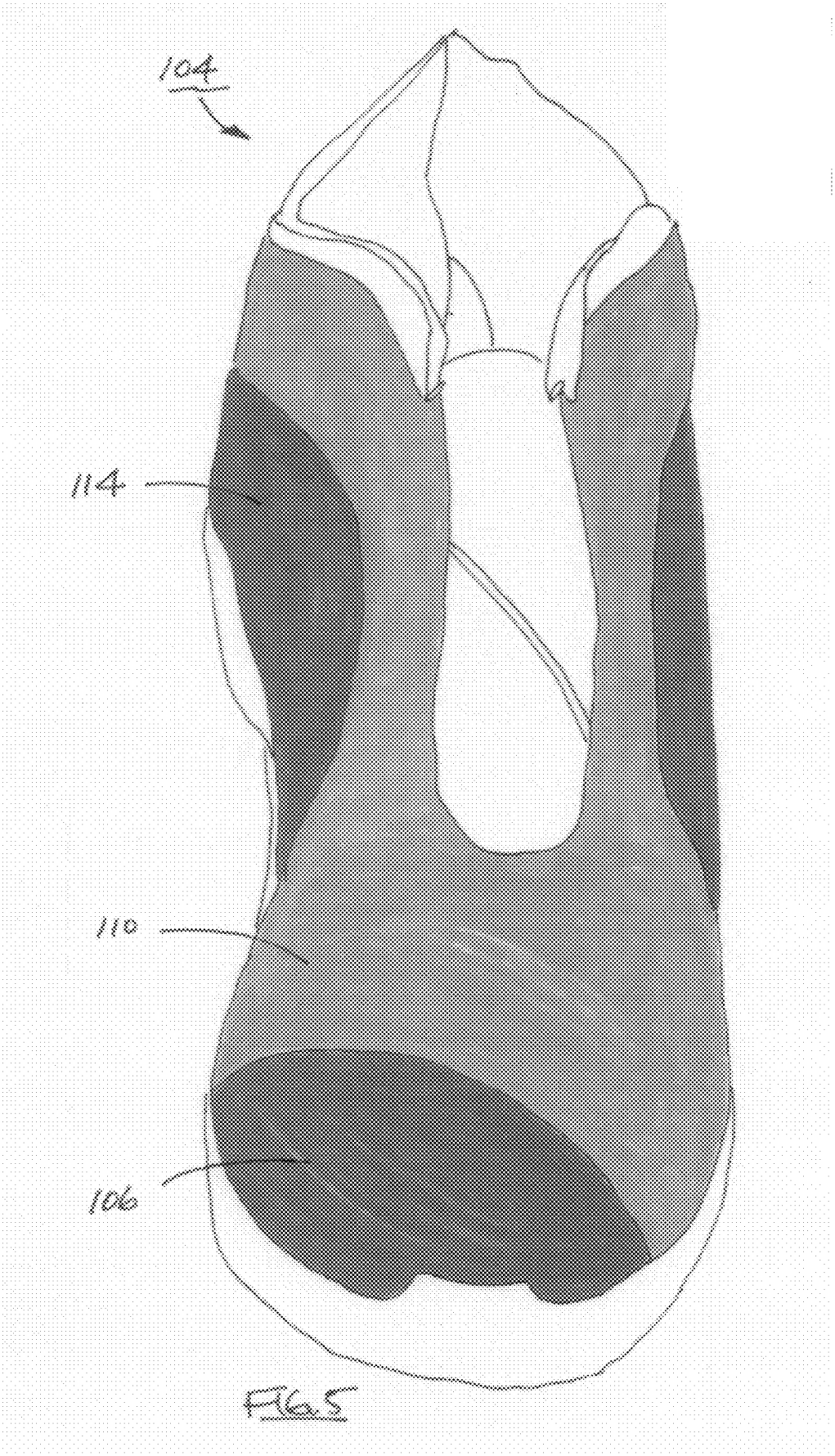
FIG. 5 is an isometric depiction of the left first gen shoe in FIG. 1.
Figure 6:
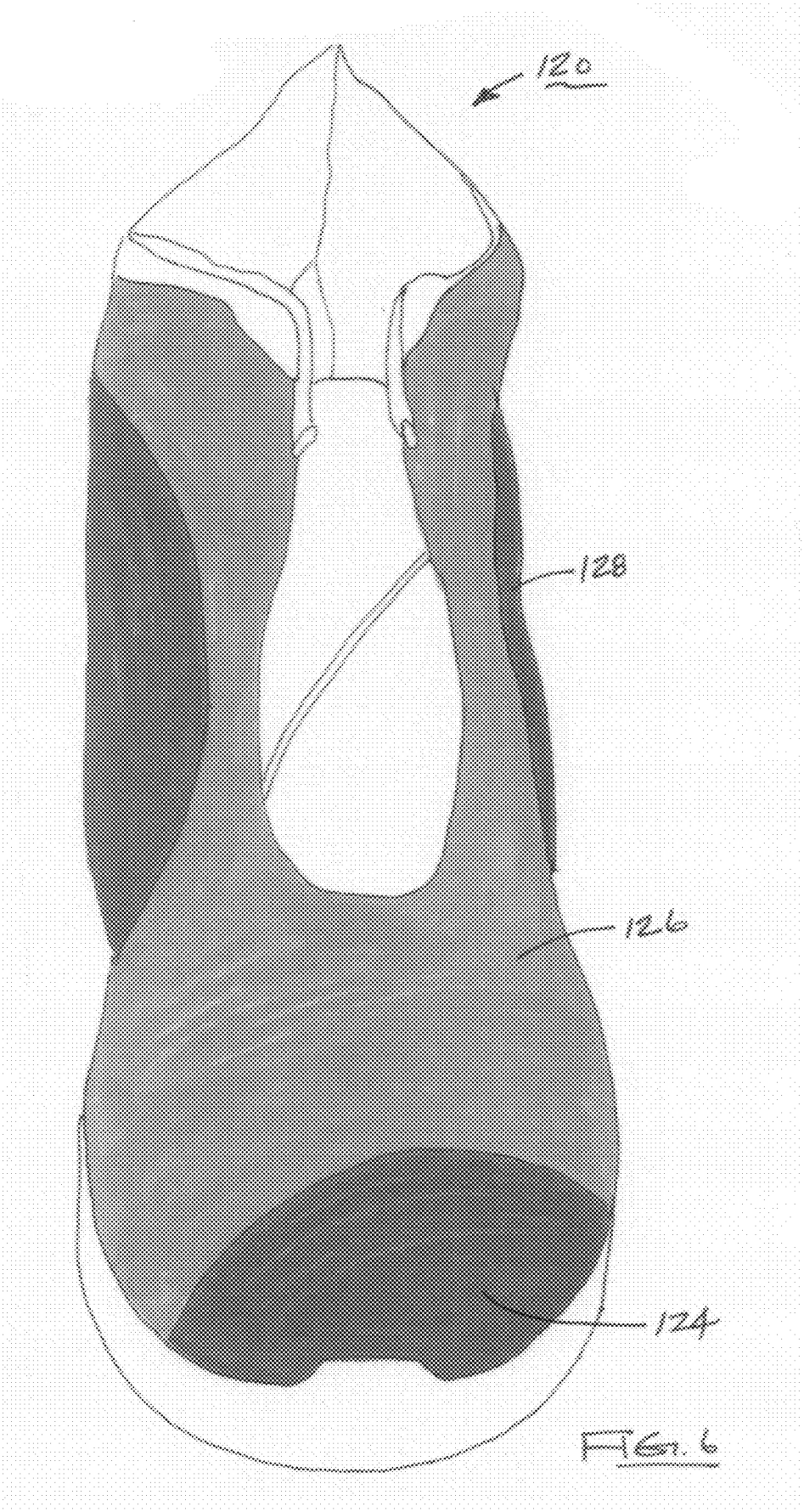
FIG. 6 is an isometric depiction of a right second gen shoe associated with the first gen shoes in FIG. 1.
Figure 7:
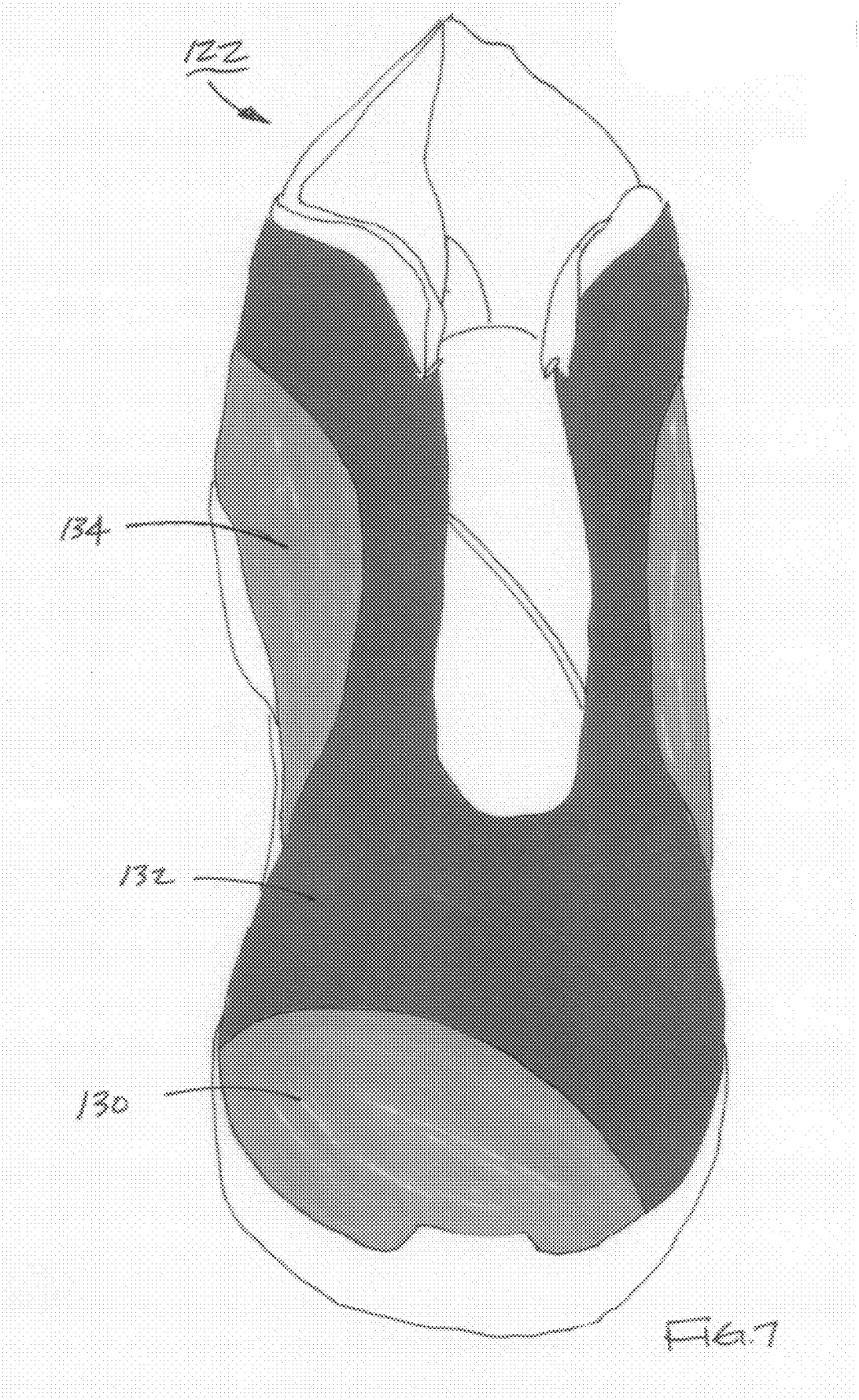
FIG. 7 is an isometric depiction of a left second gen shoe associated with the first gen shoes in FIG. 1.

FIG. 4 depicts the right shoe 100 and FIG. 5 depicts the left shoe 104. In keeping with the illustrative example the pair of shoes 100, 104 may be marketed and sold according to the marketing indicia "Flash Generation 1" or in other words "Flash Gen 1." FIGS. 6 and 7 depict a corresponding pair of shoes 120, 122 that in continuing this illustrative example are marketed and sold according to the marketing indicia "Flash Gen 2." The right shoe 100 in FIG. 4 (Flash Gen 1) is mismatched to the right shoe 120 in FIG. 6 (Flash Gen 2) in the same way that the right shoe 100 in FIG. 4 (Flash Gen 1) is mismatched to the left shoe 104 in FIG. 5 (Flash Gen 1). Particularly, the right Flash Gen 1 shoe 100 has the light-colored toe cap 102 whereas the right Flash Gen 2 shoe 120 has a dark-colored toe cap 124. Similarly, the right Flash Gen 1 shoe 100 has the dark-colored upper 108 whereas the right Flash Gen 2 shoe 120 has a light-colored upper 126. Similarly, the right Flash Gen 1 shoe 100 has the light-colored sidewall 112 whereas the right Flash Gen 2 shoe 120 has a dark-colored sidewall 128.

The left shoe 104 in FIG. 5 (Flash Gen 1) is mismatched to the left shoe 122 in FIG. 7 (Flash Gen 2) in the same way that the left shoe 104 in FIG. 5 (Flash Gen 1) is mismatched to the right shoe 100 in FIG. 4 (Flash Gen 1). Particularly, the left Flash Gen 1 shoe 104 has the dark-colored toe cap 106 whereas the left Flash Gen 2 shoe 122 has a light-colored toe cap 130. Similarly, the left Flash Gen 1 shoe 104 has the light-colored upper 110 whereas the left Flash Gen 2 shoe 122 has a dark-colored upper 132. Similarly, the left Flash Gen 1 shoe 104 has the dark-colored sidewall 114 whereas the left Flash Gen 2 shoe 122 has a light-colored sidewall 134.

Figure 8:
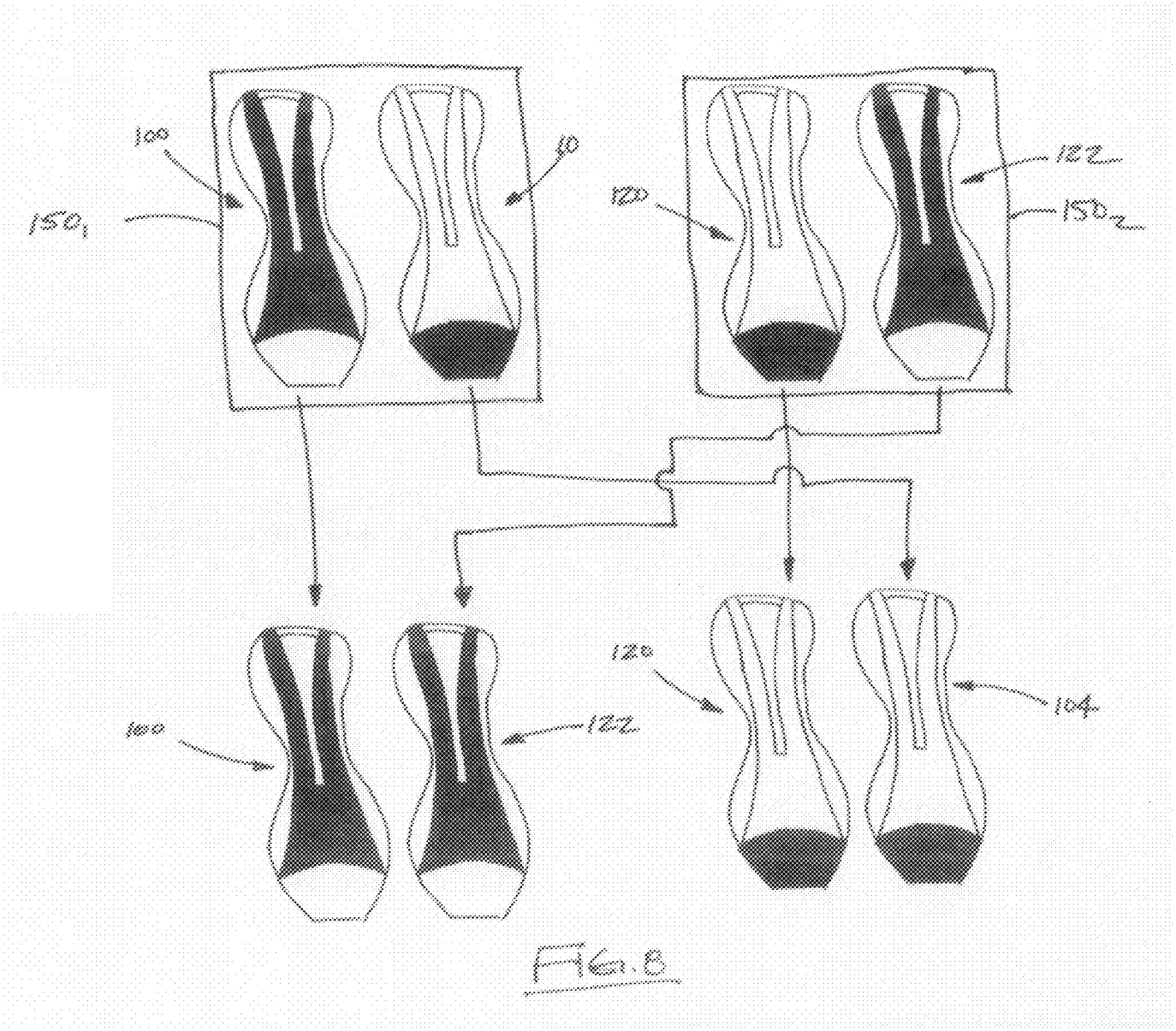
FIG. 8 is a diagrammatical depiction of the four different wearable combinations that are possible from the first generation and the second generation pairs of color-mismatched shoes.
Figure 9:
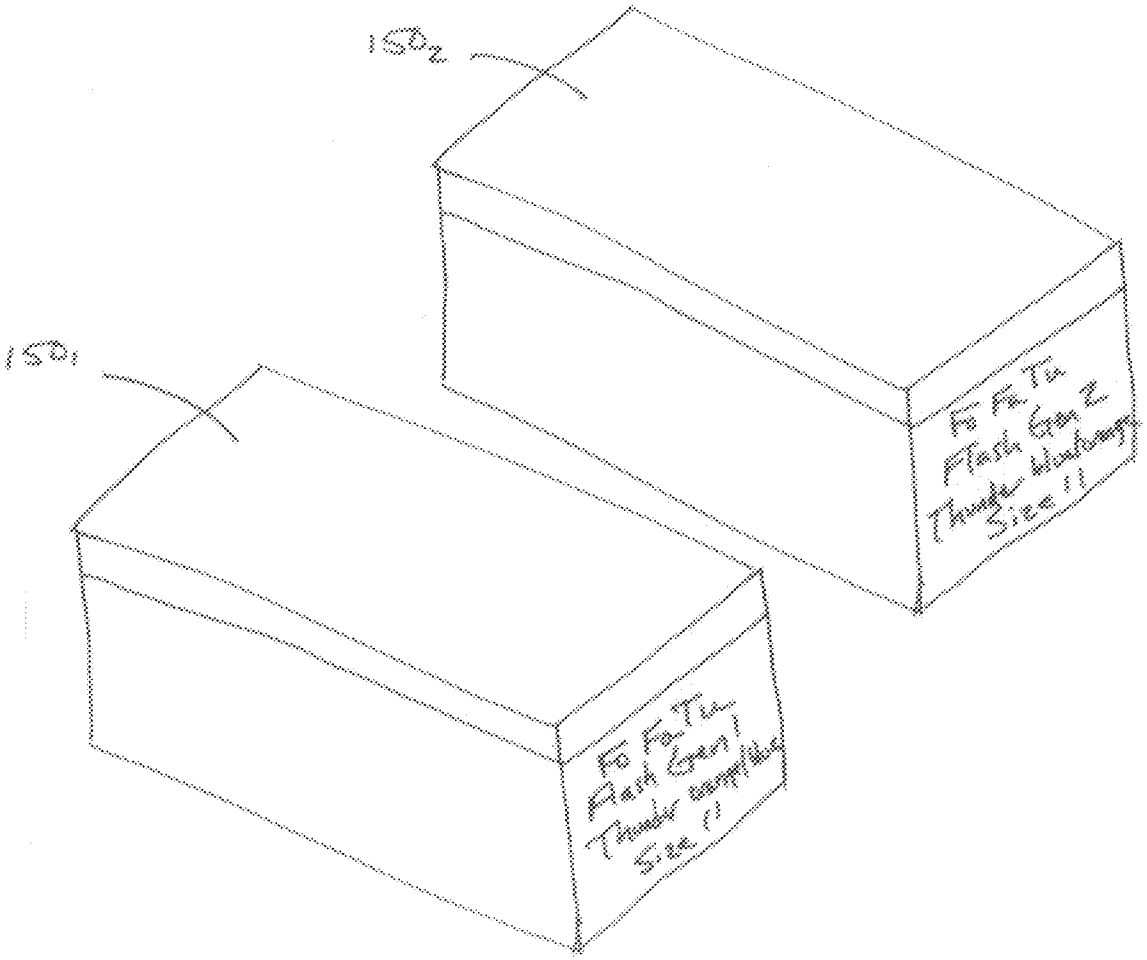
FIG. 9 is an isometric depiction of marketing indicia on the boxes containing the first generation and second generation pairs of color-mismatched shoes.

FIG. 8 depicts how a pair of shoes, one right shoe and one left shoe, is packaged in a box 150 for sale. That is, the box $\mathbf{150}_1$ contains the Flash Gen 1 shoes 100, 104 and the box $\mathbf{150}_2$ contains the Flash Gen 2 shoes 120, 122. FIG. 9 depicts how the boxes $\mathbf{150}_1$, $\mathbf{150}_2$ are individually marked with marketing indicia that communicates information to the consumer as to how to obtain the benefits of the present embodiments.

That indicia includes the brand, such as "Fo Fa Tu" in these illustrative embodiments, that informs the purchaser that the shoes contained in the box 150 are merchandised according to the multiple mismatch combinations of the present embodiments. Of course, the brand could likewise be combined with or subordinated to the manufacturer's other brand(s), such as Nike®, Adidas®, or Under Armour®, and the like. The indicia also includes the style, such as "Flash" in these illustrative embodiments, that informs the purchaser as to the construction of the shoe inside the box—the size and arrangement of the various components used in constructing the shoes. The indicia also includes the generation, "Gen 1" or "Gen 2" in these illustrative embodiments, which informs the purchaser as to the particular color arrangement for the particular style.

The manufacturer may employ a marketing strategy that informs the consumer as to which particular color mismatch is defined by each of the generations. For example, in the illustrative embodiments the marketing indicia includes the colors of the shoes inside the box 150, such as "orange/blue" depicted in FIG. 9. The consumer could be informed, such as by advertising or further descriptive instructions on the box that the first color listed in this indicia defines the color of the toe cap on the right shoe. In these illustrative embodiments the colors are modified by "Thunder" to represent the Oklahoma City Thunder of the National Basketball Association, meaning that the orange/blue colors for the shoes in the box 150 are particularly associated with the OKC Thunder team colors. In equivalent alternative embodiments other techniques can be employed to define which color mismatch defines which generation. For example, without limitation, the lighter shade of two contrasting colors can consistently define the color of the toe cap of the right shoe of the first generation, "light is right," such as the lighter orange toe cap 102 in the Flash Gen 1 shoes 100, 104 depicted in FIG. 1.

Returning to the diagram of FIG. 8, the consumer selects a certain size of either the Flash Gen 1 pair in box $\mathbf{150}_1$ or the Flash Gen 2 pair in box $\mathbf{150}_2$, or both pairs. By purchasing both pairs 100, 104 and 120, 122, the consumer obtains the ability to mix the generations to derive up to four different variations of a pair of shoes to wear at any given time. For example, one variation is to wear the Flash Gen 1 pair 100, 104. Another variation is to wear the Flash Gen 2 pair 120, 122. Another variation is to wear the right Flash Gen 1 shoe 100 and the left Flash Gen 2 shoe 122. Yet another variation is to wear the right Flash Gen 2 shoe 120 and the left Flash Gen 1 shoe 104. The total number of variations, "four," from the purchase of "two" pairs of shoes can advantageously be commercially marketed as "Four For Two," or in a proposed new hip hop vernacular "Fo Fa Tu" that arises from this technology.

These illustrative embodiments describe the consumer having decided to buy two pairs of a particular style, the first generation and the second generation pairs, in the same colors, orange and blue. The contemplated embodiments are not so limited in that in alternative embodiments the consumer can use the embodiments of the present invention to purchase either the first or second generation of a particular style in one color combination, and to purchase either the first or second generation of the same style in another color combination. Further, in the illustrative embodiments the number of colors in each shoe is two but the present embodiments are not so limited. In equivalent alternative embodiments the shoes can be constructed of more than two different colored components and mismatched so as to make it possible to form more than four total mismatch combinations. For example, without limitation, in other illustrative embodiments shoes could be constructed with the toe cap being a first color, the upper being a different second color, and the sidewall being yet another different third color. In that circumstance the marketing indicia of the present embodiments can be employed as described herein to define first, second, and third generation pairs of shoes. A purchaser of all three pairs of those shoes is capable of combining the shoes into eight different color mismatch combinations.

Figure 10:
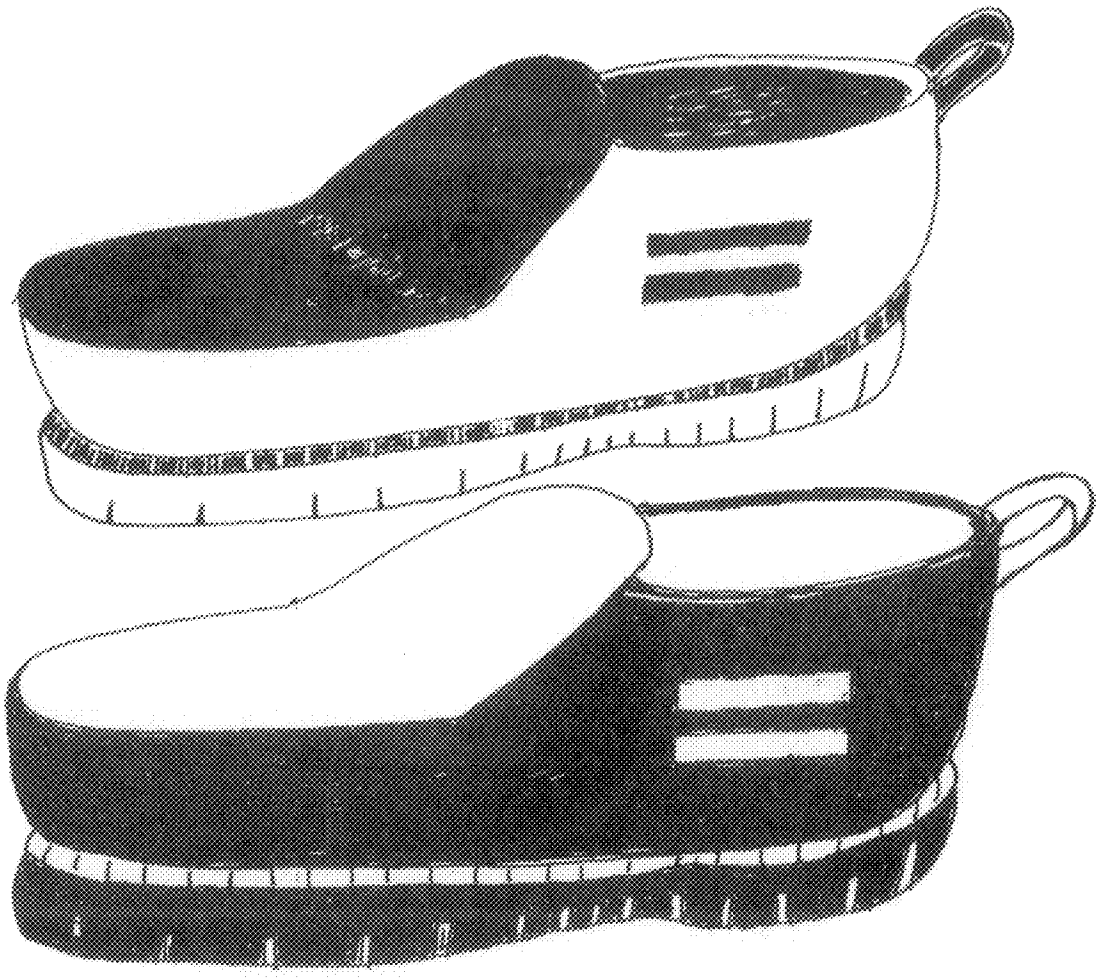
FIG. 10 is an isometric depiction of a different pair of second gen shoes marketed as a subset of a larger group of shoes in accordance with equivalent alternative embodiments of the present invention.
Figure 11:
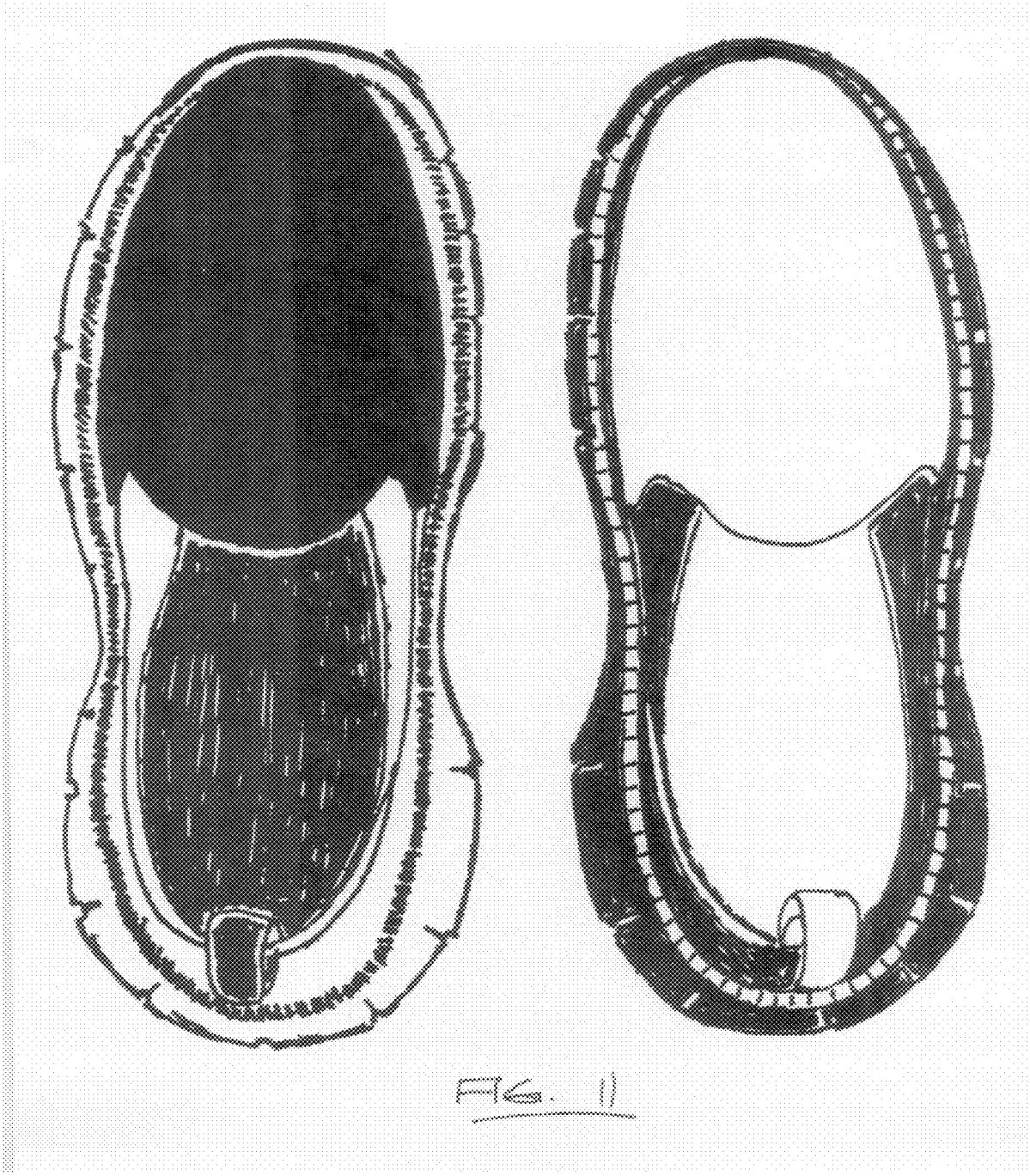
FIG. 11 is a top depiction of a pair of first gen shoes corresponding to the second gen shoes in FIG. 10.

All that has been described above is related to pairs of sneakers. The "Fo Fa Tu" marketing and packaging technology equivalently applies to any other kind of footwear as well. For example, without limitation, FIG. 10 is an isometric depiction of a Gen 2 style of loafer, and FIG. 9 is a top depiction of a Gen 1 style of loafer, in the same manner described above for the sneakers and the definition that "light is right," meaning the lighter shade of the two contrasting colors defines the toe cap of the right shoe in the first generation (FIG. 11).

It is to be understood that even though numerous characteristics and advantages of various embodiments of the invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, features of the illustrated embodiments can be interchanged and the particular elements may vary depending on the particular application while maintaining substantially the same functionality without departing from the scope and spirit of the present invention. In addition, although preferred embodiments described herein are illustrated in relation to footwear it will be appreciated by those skilled in the art that the teachings of the present invention can be applied to other articles of clothing without departing from the scope and spirit of the embodiments of the present invention.

What is claimed:

1. An apparatus, in combination comprising:

a pair of color-mismatched shoes, a first shoe of the pair of shoes constructed of a toe cap of a first color and an upper of a different second color, and a second shoe of the pair of shoes constructed of a toe cap of the second color and an upper of the first color;

a package sized to contain the pair of shoes; and an indicia system on the package including a brand that identifies the pair of shoes are color-mismatched.

2. The apparatus of claim 1 wherein the indicia system comprises a style indicia that identifies characteristic shapes of the toe caps and the uppers.

3. The apparatus of claim 2 wherein the indicia system comprises a generation level indicia that identifies the color of the toe cap of one of the shoes.

4. The apparatus of claim 1 wherein the first shoe is constructed of a sidewall of the first color.

5. The apparatus of claim 4 wherein the second shoe is constructed of a sidewall of the second color.

6. The apparatus of claim 1 wherein the toe cap and the upper are contiguous in each shoe of the pair of shoes.

7. The apparatus of claim 4 wherein the toe cap and the upper are contiguous in each shoe of the pair of shoes.

8. The apparatus of claim 7 wherein the sidewall and the upper are contiguous in each shoe of the pair of shoes.

9. A method comprising:

obtaining a pair of color-mismatched shoes, a first shoe of the pair of shoes constructed of a toe cap of a first color and an upper of a different second color, a second shoe of the pair of shoes constructed of a toe cap of the second color and an upper of the first color;

packaging the shoes in a container;

marking the container with an indicia system that includes a brand that identifies the shoes are color-mismatched, a style that identifies a particular construction of the color-mismatched shoes, and a generation level that identifies the arrangement of colors in the color-mismatched shoes.

* * * * *